US010655411B2

(12) United States Patent
Fripp et al.

(10) Patent No.: US 10,655,411 B2
(45) Date of Patent: May 19, 2020

(54) DEGRADABLE, FRANGIBLE COMPONENTS OF DOWNHOLE TOOLS

(71) Applicant: Halliburton Energy Services, Inc., Houston, TX (US)

(72) Inventors: Michael Linley Fripp, Carrollton, TX (US); Zachary William Walton, Carrollton, TX (US); Matthew James Merron, Dallas, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 155 days.

(21) Appl. No.: 15/762,535

(22) PCT Filed: Dec. 29, 2015

(86) PCT No.: PCT/US2015/067783
§ 371 (c)(1),
(2) Date: Mar. 22, 2018

(87) PCT Pub. No.: WO2017/116407
PCT Pub. Date: Jul. 6, 2017

(65) Prior Publication Data

US 2019/0078408 A1 Mar. 14, 2019

(51) Int. Cl.
*E21B 23/06* (2006.01)
*E21B 17/00* (2006.01)
(Continued)

(52) U.S. Cl.
CPC ..... *E21B 23/06* (2013.01); *E21B 17/003* (2013.01); *E21B 33/1208* (2013.01);
(Continued)

(58) Field of Classification Search
CPC .... E21B 23/06; E21B 17/003; E21B 33/1208; E21B 43/26; E21B 33/134; E21B 34/14; E21B 41/0035; E21B 41/0085
See application file for complete search history.

(56) References Cited

U.S. PATENT DOCUMENTS 5,924,696 A 7/1999 Frazier
5,957,209 A 9/1999 Burleson et al.
(Continued)

FOREIGN PATENT DOCUMENTS

WO WO-2015/030715 A1 3/2015

OTHER PUBLICATIONS

International Search Report and Written Opinion from PCT/US2015/067783, dated Sep. 6, 2016, 14 pages.

*Primary Examiner* — Yong-Suk Ro
(74) *Attorney, Agent, or Firm* — McGuireWoods LLP

(57) ABSTRACT

Frangible components like shear pins, rupture disks, retainer rings, and shear rings of downhole tools (e.g., frac plugs, sliding sleeves, darts, packers, expansion joints, valves, and tool-conveyance coupling apparatuses) may be composed of a degradable material that degrades in a wellbore environment at a desired time during the performance of a subterranean formation operation. For example, a tool string may include a conveyance or top adapter sub threadably coupled to a first end of a stinger; a wellbore tool coupled to the stinger via a coupling at a second end opposing the first end of the stinger, wherein the coupling comprises a frangible, degradable shear pin and a frangible, degradable shear ring, wherein the frangible, degradable shear pin and the frangible, degradable shear ring independently comprise a degradable metal alloy selected from the group consisting of a magnesium alloy, an aluminum alloy, and any combination thereof.

14 Claims, 3 Drawing Sheets

(51) Int. Cl.

| | |
|---|---|
| ***E21B 33/12*** | (2006.01) |
| ***E21B 43/26*** | (2006.01) |
| *E21B 33/134* | (2006.01) |
| *E21B 34/14* | (2006.01) |
| *E21B 41/00* | (2006.01) |

(52) U.S. Cl.
CPC ..... *E21B 43/26* (2013.01); *E21B 33/134* (2013.01); *E21B 34/14* (2013.01); *E21B 41/0035* (2013.01); *E21B 41/0085* (2013.01)

(56) References Cited

U.S. PATENT DOCUMENTS

| | | | | |
|---|---|---|---|---|
| 7,322,412 | B2 | 1/2008 | Badalamenti et al. | |
| 7,726,406 | B2 | 6/2010 | Xu | |
| 8,622,141 | B2 | 1/2014 | Fay | |
| 9,850,738 | B2 * | 12/2017 | Frazier | E21B 33/134 |
| 2008/0149345 | A1 | 6/2008 | Marya et al. | |
| 2008/0149351 | A1 * | 6/2008 | Marya | E21B 23/00 166/387 |
| 2014/0060852 | A1 | 3/2014 | Smith et al. | |
| 2016/0333655 | A1 * | 11/2016 | Fripp | E21B 33/063 |

* cited by examiner

DEGRADABLE, FRANGIBLE COMPONENTS OF DOWNHOLE TOOLS

BACKGROUND

The present disclosure describes embodiments of frangible components of wellbore tools.

In the drilling, completion, and stimulation of hydrocarbon-producing wells, a variety of downhole tools are used. Many of these wellbore tools and components thereof have multiple configurations that can be actuated between. For example, some wellbore tools like wellbore liners have fluid ports that can be closed or opened by changing the position of a sleeve to cover or uncover the fluid ports. Oftentimes, a wellbore tool is conveyed through a wellbore and placed in a desired location along the wellbore in a first configuration. Then, once placed, the wellbore tool or a portion thereof is actuated to a second configuration.

In some instances, actuation of the wellbore tool is accomplished by breaking a frangible component like a shear pin by applying the requisite shear stress. Many of these frangible components completely break away from the wellbore tool after the shear stress is applied. The pieces of the frangible components then become debris in the wellbore that can interfere with the operation of the wellbore tool, impede the production of hydrocarbons, or both.

BRIEF DESCRIPTION OF THE DRAWINGS

The following figures are included to illustrate certain aspects of the embodiments, and should not be viewed as exclusive embodiments. The subject matter disclosed is capable of considerable modifications, alterations, combinations, and equivalents in form and function, as will occur to those skilled in the art and having the benefit of this disclosure.

DETAILED DESCRIPTION

Figure 1:
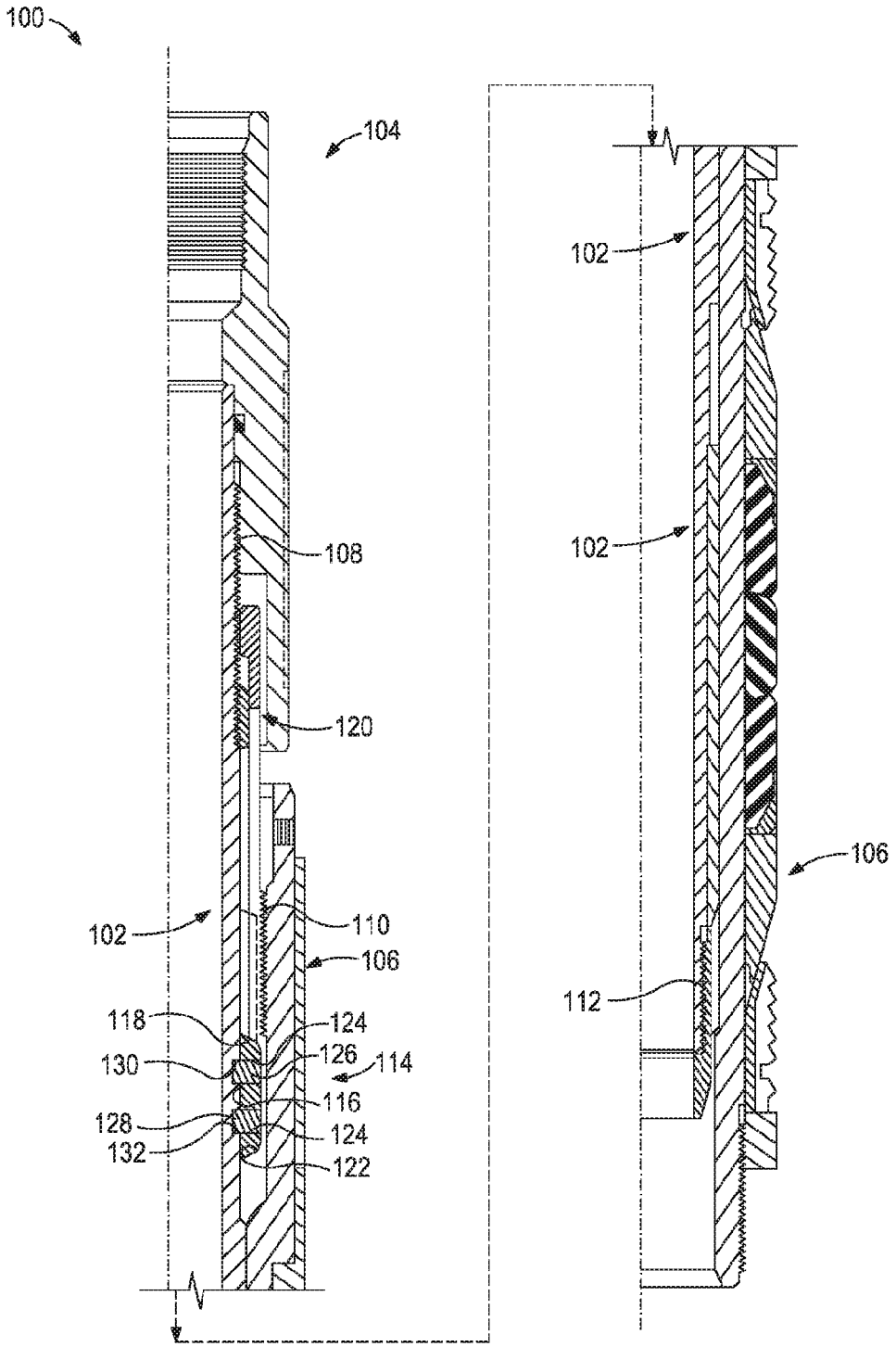
FIG. 1 illustrates a tool string that includes a stinger that couples a top adapter sub to a wellbore tool.

The present disclosure describes embodiments of frangible components of wellbore tools that are made of degrading materials, and their methods of use during a subterranean formation operation. In particular, the present disclosure describes frangible components like shear pins, rupture disks, retainer rings, and shear rings that are composed of a degradable material (also referred to herein as "degradable, frangible components") that degrades in a wellbore environment at a desired time during the performance of a subterranean formation operation (or simply "formation operation"). These degradable materials (also referred to collectively as "degradable substances") are discussed in greater detail below.

One or more illustrative embodiments disclosed herein are presented below. Not all features of an actual implementation are described or shown in this application for the sake of clarity. It is understood that in the development of an actual embodiment incorporating the embodiments disclosed herein, numerous implementation-specific decisions must be made to achieve the developer's goals, such as compliance with system-related, lithology-related, business-related, government-related, and other constraints, which vary by implementation and from time to time. While a developer's efforts might be complex and time-consuming, such efforts would be, nevertheless, a routine undertaking for those of ordinary skill in the art having benefit of this disclosure.

It should be noted that when "about" is provided herein at the beginning of a numerical list, the term modifies each number of the numerical list. In some numerical listings of ranges, some lower limits listed may be greater than some upper limits listed. One skilled in the art will recognize that the selected subset will require the selection of an upper limit in excess of the selected lower limit. Unless otherwise indicated, all numbers expressing quantities of ingredients, properties such as molecular weight, reaction conditions, and so forth used in the present specification and associated claims are to be understood as being modified in all instances by the term "about." As used herein, the term "about" encompasses +/−5% of each numerical value. For example, if the numerical value is "about 80%," then it can be 80%+/−5%, equivalent to 76% to 84%. Accordingly, unless indicated to the contrary, the numerical parameters set forth in the following specification and attached claims are approximations that may vary depending upon the desired properties sought to be obtained by the exemplary embodiments described herein. At the very least, and not as an attempt to limit the application of the doctrine of equivalents to the scope of the claim, each numerical parameter should at least be construed in light of the number of reported significant digits and by applying ordinary rounding techniques.

While compositions and methods are described herein in terms of "comprising" various components or steps, the compositions and methods can also "consist essentially of" or "consist of" the various components and steps. When "comprising" is used in a claim, it is open-ended.

As used herein, the term "substantially" means largely, but not necessarily wholly.

The use of directional terms such as above, below, upper, lower, upward, downward, left, right, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well.

The embodiments of the present disclosure are directed toward degradable, frangible components of wellbore tools. As used herein, the term "degradable" and all of its grammatical variants (e.g., "degrade," "degradation," "degrading," "dissolve," dissolving," and the like), refers to the dissolution or chemical conversion of solid materials such that reduced-mass solid end products result or reduced structural integrity results by at least one of solubilization, hydrolytic degradation, biologically formed entities (e.g., bacteria or enzymes), chemical reactions (including electrochemical and galvanic reactions), thermal reactions, reactions induced by radiation, or combinations thereof. In complete degradation, no solid end products result, or structural shape is lost. In some instances, the degradation of the material may be sufficient for the mechanical properties of the material to be reduced to a point that the material no longer maintains its integrity and, in essence, falls apart or sloughs off into its surroundings. The conditions for degradation are generally wellbore conditions where an external stimulus may be used to initiate or effect the rate of degradation, where the external stimulus is naturally occurring in the wellbore (e.g., pressure, temperature) or introduced into the wellbore (e.g., fluids, chemicals). For example, the pH of the fluid that interacts with the material may be changed by introduction of an acid or a base, or an electrolyte may be introduced or naturally occurring to induce galvanic corrosion. The term "wellbore environment," and grammatical variants thereof, includes both naturally occurring wellbore environments and materials or fluids introduced into the wellbore. The term "at least a portion," and grammatical variants thereof, with reference to a component having at least a portion composed thereof of a degradable material or substance (e.g., "at least a portion of a component is degradable" and variants thereof) refers to at least about 80% of the volume of that part being formed of the degradable material or substance.

Exemplary degradable, frangible components may include, but are not limited to, shear pins, rupture disks, retainer rings, and shear rings that may be used in wellbore tools including, but not limited to, frac plugs, sliding sleeves, darts, packers, expansion joints, valves, tool-conveyance coupling apparatuses, and the like. Such wellbore tools may be actuated from one position or configuration to another. Actuation may be achieved mechanically, electrically, hydraulically, or other by any other suitable mode. For example, a wireline or coiled tubing may be used to send an electrical signal to the wellbore tool that causes the wellbore tool to actuate. In another example, a dart or ball may be sent through the wellbore and mechanically actuate the wellbore tool.

As used herein, the term "shear pin" refers to an elongated component that inserts in apertures of a wellbore tool so as to retain sliding components of the wellbore tool in a fixed position until a force sufficient is applied to break the shear pin or a component thereof and actuate the wellbore tool. The "shear pin" may be smooth, threaded, or partially threaded and, as used herein, encompasses shear rods and shear screws. In some instances, the shear pin may be partially threaded where the amount and configuration of threads provides sufficient tensile strength or sufficient shear strength to maintain the fixed position of the wellbore tool and the force applied to actuate the tool shears the threads.

FIG. 1 illustrates a tool string 100 that includes a stinger 102 (an example of a tool-conveyance coupling apparatus) that couples a top adapter sub 104 (sometimes referred to as a power mandrel) to a wellbore tool (illustrated as a packer 106). More specifically, the stinger 102 is threadably mated at its upper end to the top adapter sub 104 at a threaded coupling 108 and threadably mated at its lower end to the packer 106 at two threaded couplings 110,112. In addition, the threaded couplings 110,112, the mating mechanism between the packer 106 and the stinger 102 includes a degradable, frangible shear ring 114 having an internal bore 116.

The upper portion of the internal bore 116 of the degradable, frangible shear ring 114 terminates at a chamfered surface 118 that is complimentary to the angle of an abutting collet finger member 120. At the point where the internal bore 116 and the collet finger member 120 abut, the load is concentrated on the chamfered surface 118.

The upper portion of the internal bore 116 of the degradable, frangible shear ring 114 terminates at a chamfered surface 122. The degradable, frangible shear ring 114 has bored therethrough a plurality of degradable, frangible shear pin apertures 124. Degradable, frangible shear pins 126,128 are inserted therethrough and into the apertures 130,132 of the stinger 102.

During operation, the tool string 100 is conveyed through a wellbore by a conveyance (not illustrated) (e.g., a wireline, a coiled tubing, a work string, and the like) coupled to the top adapter sub 104. Once the packer 106 is actuated to engage the wellbore, tension is applied to stinger 102. For example, tension may be applied to the conveyance and transmitted through the top adapter sub 104 to the stinger 102 where the collet finger member 120 applies pressure to the chamfered surface 118 of the degradable, frangible shear ring 114. Once a predetermined force has been applied, the degradable, frangible shear pins 126,128, located in the degradable, frangible shear ring 114, will shear, thereby releasing the stinger 102 and the top adapter sub 104 from the packer 106.

The degradable, frangible shear ring 114, the degradable, frangible shear pins 126,128, or portions thereof may break completely free from the stinger 102 and be left in the wellbore. Fluids from the formation or introduced to the wellbore may then degrade the degradable, frangible shear ring 114, the degradable, frangible shear pins 126,128, or portions thereof to reduce the amount of debris or large debris in the wellbore that may interfere with the operation of other wellbore tools, stimulation of the formation, the production of hydrocarbons, or a combination thereof.

Figure 2:
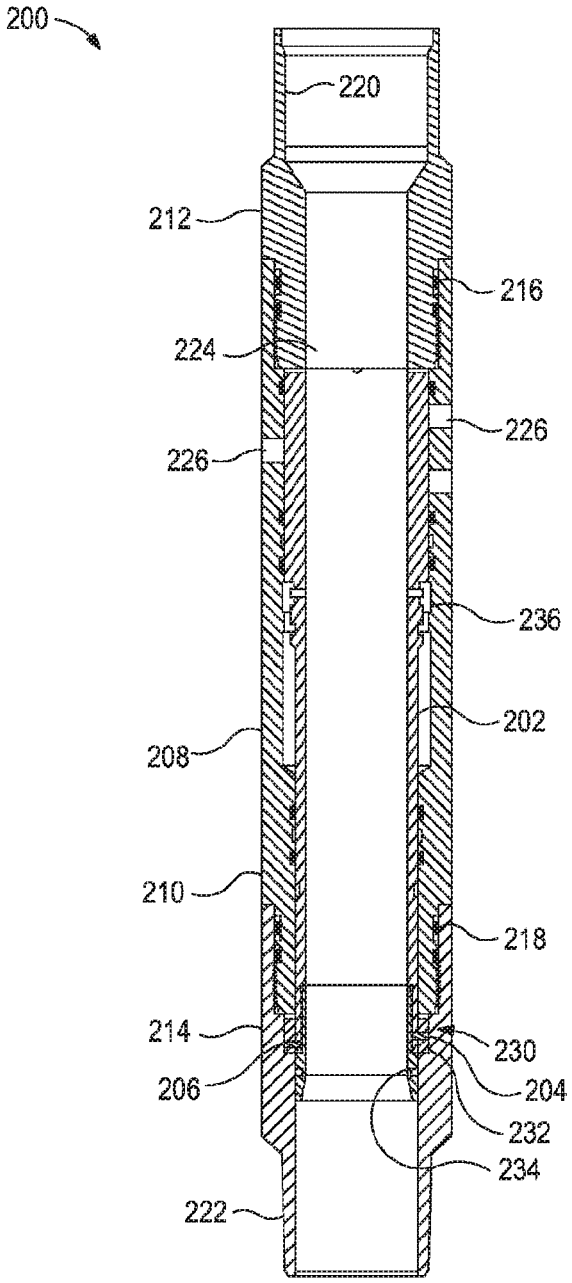
FIG. 2 illustrates a wellbore stimulation assembly having a sliding sleeve assembly with degradable, frangible shear pins and degradable, frangible shear rings.

FIG. 2 illustrates a wellbore stimulation assembly 200 having a sliding sleeve assembly 202 with degradable, frangible shear pins 204,206 and degradable, frangible shear rings 232,234. More specifically, the illustrated sliding sleeve assembly 202 is pressure-activated that is actuated when the degradable, frangible shear pins 202,204 shear.

The wellbore stimulation assembly 200 has a pin end section 214. The box end section 212 and pin end section 214 are threaded to central section 208 with O-rings 216,218 providing a seal between the respective sections. Box end section 212 terminates in a box fitting 220 and pin end section terminates in a pin fitting 222 for connection to other casing sections, as is known in the art. Housing 208 defines a central longitudinal bore 224 through which hydrocarbons can flow and tooling can be run.

The sliding sleeve 100 includes a radial array of ports 226 formed through central section 222 of housing 208 that allow for hydrocarbons to flow into the wellbore from the production zone or wellbore fluids to flow into the production zone.

The pressure-activated sliding sleeve assembly 202 is coaxially positioned within the central section 210 and pin end section 214 of housing 208. FIG. 2 illustrates the sliding sleeve assembly 202 located in an initial "shut" position. A ring-shaped shear pin assembly 230 and a "C"-shaped locking mechanism 236 hold the wellbore stimulation assembly 200 in the shut position. Once pressure has reached a certain high pressure threshold, for example, a hydrostatic test pressure, and the pressure is subsequently reduced below a second lower opening pressure, the wellbore stimulation assembly 200 opens so that the ports 226 are in fluid communication with central bore 224.

The shear pin assembly 230 includes an outer degradable, frangible shear ring 232 that abuts and is slideably engaged about an inner degradable, frangible shear ring 234. One or more holes are formed radially through outer and inner degradable, frangible shear rings 232,234, and the degradable, frangible shear pins 204,206 are received by these holes. When an axial force on inner degradable, frangible shear ring 234 with respect to outer degradable, frangible shear ring 232 exceeds the shear force of and the shear pins 204,206 ("activation pressure"), the degradable, frangible shear pins 204,206 will shear so as to actuate the sliding sleeve assembly 202.

The degradable, frangible shear rings 232,234, the degradable, frangible shear pins 204,206, or portions thereof may break completely free from the wellbore stimulation assembly 200 and be left in the wellbore. Fluids from the formation or introduced to the wellbore may then degrade the degradable, frangible shear rings 232,234, the degradable, frangible shear pins 204,206, or portions thereof to reduce the amount of debris or large debris in the wellbore that may interfere with the operation of other wellbore tools, stimulation of the formation, the production of hydrocarbons, or a combination thereof.

In some instances, one or more of the degradable, frangible shear pins 126,128,204,206 of FIGS. 1 and 2 may be degradable, frangible shear rods, degradable, frangible shear screws, or the like. One skilled in the art would recognize the modifications to stinger 102 and the sliding sleeve assembly 202 for such substitutions.

Some embodiments of the present disclosure relate to methods of using or implementing a wellbore tool with one or more degradable, frangible components. The degradable materials of the degradable, frangible components may be chosen to allow for sufficient time between placement of the wellbore tool and when a particular downhole operation is undertaken, such as a hydraulic fracturing operation. Moreover, the degradable materials described herein allow for acid treatments and acidified stimulation of a wellbore.

The degradable, frangible components described herein (e.g., shear pins, shear screws, rupture disks, retainer rings, and shear rings) are degraded at least partially in the wellbore environment. As used herein, the term "at least partially degrading," and grammatical variants thereof (e.g., "degrading at least partially," "partially degrades," and the like) with reference to degradation of a component thereof of a wellbore tool refers to the component degrading at least to the point wherein about 20% or more of the mass of the component degrades. For instance, the degradable metal alloy forming the degradable, frangible components described herein is at least partially degraded in the presence of an electrolyte in the wellbore environment. The production of a hydrocarbon (i.e., oil and/or gas) from the subterranean formation may proceed. In some instances, degradation of the degradable material and production of a hydrocarbon may occur simultaneously, or alternatively in series, without departing from the scope of the present disclosure. That is, the order, if any, of degradation and production may depend on selection of the particular degradable material (e.g., the degradable metal alloy or alloy combination), the degradation stimuli (e.g., the electrolyte or other stimulus), and the like, and any combination thereof. In some embodiments, accordingly, production may begin before degradation, or degradation may begin before production. Although degradation may begin and end before production begins, it is contemplated that both degradation and production will occur simultaneously during at least some point in time (or duration), regardless of which process is initiated first.

Figure 3:
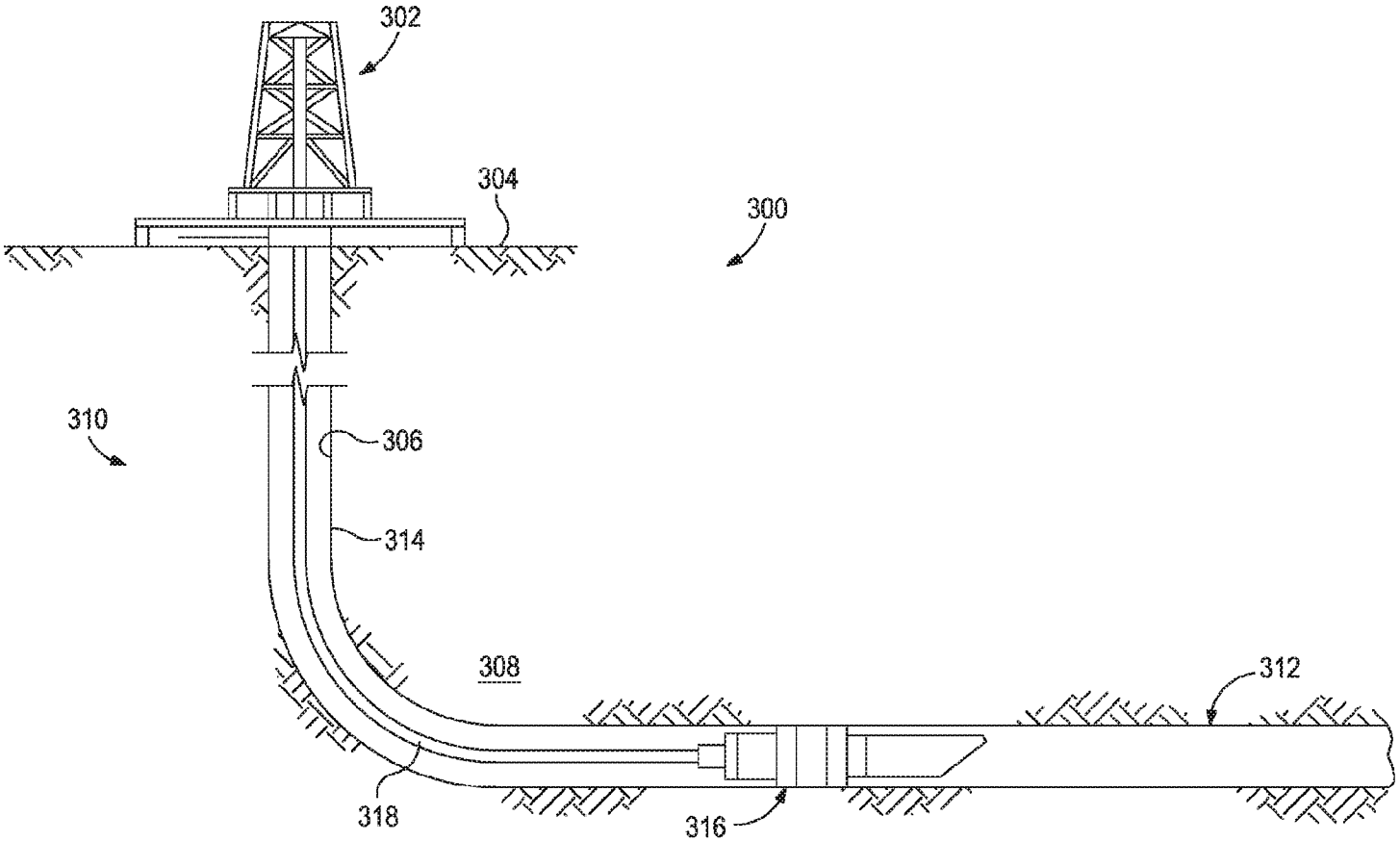
FIG. 3 illustrates a well system that may embody or otherwise employ one or more principles of the present disclosure, according to one or more embodiments.

FIG. 3 illustrates a well system 300 that may embody or otherwise employ one or more principles of the present disclosure, according to one or more embodiments. As illustrated, the well system 300 may include a service rig 302 (also referred to as a "derrick") that is positioned on the earth's surface 304 and extends over and around a wellbore 306 that penetrates a subterranean formation 308. The service rig 302 may be a drilling rig, a completion rig, a workover rig, or the like. In some embodiments, the service rig 302 may be omitted and replaced with a standard surface wellhead completion or installation, without departing from the scope of the disclosure. While the well system 300 is depicted as a land-based operation, it will be appreciated that the principles of the present disclosure could equally be applied in any sea-based or sub-sea application where the service rig 302 may be a floating platform or sub-surface wellhead installation, as generally known in the art.

The wellbore 306 may be drilled into the subterranean formation 308 using any suitable drilling technique and may extend in a substantially vertical direction away from the earth's surface 304 over a vertical wellbore portion 310. At some point in the wellbore 306, the vertical wellbore portion 310 may deviate from vertical relative to the earth's surface 304 and transition into a substantially horizontal wellbore portion 312, although such deviation is not required. That is, the wellbore 306 may be vertical, horizontal, or deviated, without departing from the scope of the present disclosure. In some embodiments, the wellbore 306 may be completed by cementing a string of casing 314 within the wellbore 306 along all or a portion thereof. As used herein, the term "casing" refers not only to casing as generally known in the art, but also to borehole liner, which comprises tubular sections coupled end to end but not extending to a surface location. In other embodiments, however, the string of casing 314 may be omitted from all or a portion of the wellbore 306 and the principles of the present disclosure may equally apply to an "open-hole" environment.

The well system 300 may further include a wellbore tool 316 comprising one or more degradable, frangible components. The wellbore tool 316 may be conveyed into the wellbore 306 on a conveyance 318 that extends from the service rig 302. The conveyance 318 may include or otherwise comprise any type of conveyance known to those skilled in the art including, but not limited to, a wireline, a coiled tubing, drill pipe, production tubing, slickline, an electric line, and the like. The wellbore tool 316 may include or otherwise comprise any type of wellbore tool known to those skilled in the art including, but not limited to, frac plugs, sliding sleeves, darts, packers, expansion joints, valves, tool-conveyance coupling apparatuses, and the like.

The conveyance 318 delivers or otherwise conveys the wellbore tool 316 downhole to a target location (not shown) within the wellbore 306. At the target location, the wellbore tool 316 may be actuated or "set" to seal the wellbore 306 and otherwise provide a point of fluid isolation within the wellbore 306. In some embodiments, the wellbore tool 316 is pumped to the target location using hydraulic pressure applied from the service rig 302 at the surface 304. In such embodiments, the conveyance 318 serves to maintain control of the wellbore tool 316 as it traverses the wellbore 306 and provides the necessary power to actuate and set the wellbore tool 316 upon reaching the target location. In other embodiments, the wellbore tool 316 freely falls to the target location under the force of gravity to traverse all or part of the wellbore 306.

Actuation of the wellbore tool 316 may be by triggered by the breaking of the degradable, frangible components thereof. For example, as described above relative to FIG. 2, degradable, frangible shear pin and degradable, frangible shear rings may break from an applied shear stress to actuate the wellbore tool 316. Breaking the shear rings, shear pins, or other components producing pieces of the component (e.g., at least two pieces and often a multitude of pieces like 10 or greater). Some or all of the pieces may dissociate from the wellbore tool 316 and become debris in the wellbore.

In some embodiments that may be in combination with or alternative to the wellbore tool 316 comprise one or more degradable, frangible components, the coupling between the wellbore tool 316 and the conveyance 318 may comprise one or more degradable, frangible components. For example, the coupling may include shear pins or the like comprising a degradable material, as described in FIG. 1. The shear pins may be broken once the wellbore tool 316 is properly placed in the wellbore 306, thereby decoupling the conveyance 318 and the wellbore tool 306.

It will be appreciated by those skilled in the art that even though FIG. 3 depicts the wellbore tool 316 as being arranged and operating in the horizontal portion 312 of the wellbore 306, the embodiments described herein are equally applicable for use in portions of the wellbore 306 that are vertical, deviated, or otherwise slanted. It should also be noted that a plurality of wellbore tools 316 may be placed in the wellbore 306. In some embodiments, for example, several (e.g., six or more) wellbore tools 316 may be arranged in the wellbore 306 to divide the wellbore 306 into smaller intervals or "zones" for hydraulic stimulation.

In some embodiments, the wellbore tool 316 includes not only one or more degradable, frangible components described herein but may also include other components that are formed, at least in part, by a degradable material. Such wellbore tools 316 may be designed to decompose over time while operating in a wellbore environment, thereby eliminating the need to mill or drill the wellbore tool 316 out of the wellbore 306, whether such degradation begins before or after production of hydrocarbons therefrom.

The degradable materials that compose the degradable, frangible components described herein are preferably degradable metals, degradable metal alloys, or a combination thereof. Further, these degradable materials may preferably be degraded with exposure to aqueous fluids comprising electrolytes (also referred to herein as "electrolyte aqueous solution"). More generally, the aqueous fluid that may degrade the degradable materials when exposed thereto may include, but is not limited to, fresh water, saltwater (e.g., water containing one or more salts dissolved therein), brine (e.g., saturated salt water), seawater, or combinations thereof. Accordingly, the aqueous fluid may comprise ionic salts, which form an electrolyte aqueous solution particularly suitable for degradation of the degradable metal material, for example, and as discussed in greater detail below. The aqueous fluid may come from the wellbore 306, the subterranean formation 302, or both, may be introduced by a wellbore operator, or may be combination thereof.

In some instances, other components of the wellbore tool 316 may be formed of degradable materials like degradable elastomers that with exposure to hydrocarbon fluids. The hydrocarbon fluids may include, but are not limited to, crude oil, a fractional distillate of crude oil, a fatty derivative of an acid, an ester, an ether, an alcohol, an amine, an amide, or an imide, a saturated hydrocarbon, an unsaturated hydrocarbon, a branched hydrocarbon, a cyclic hydrocarbon, and any combination thereof. The elevated temperature may be above the glass transition temperature of the degradable elastomer like a thiol-based polymer. In some instances, the elevated temperature may be a temperature greater than about 60° C. (140° F.).

The degradable materials forming various components of the wellbore tool 316 may degrade by a number of mechanisms. For example, the degradable substances may degrade by galvanic corrosion, swelling, dissolving, undergoing a chemical change, undergoing thermal degradation in combination with any of the foregoing, and any combination thereof. Degradation by galvanic corrosions refers to corrosion occurring when two different metals or metal alloys are in electrical connectivity with each other and both are in contact with an electrolyte, and include microgalvanic corrosion. As used herein, the term "electrical connectivity" means that the two different metals or metal alloys are either touching or in close proximity to each other such that when contacted with an electrolyte, the electrolyte becomes electrically conductive and ion migration occurs between one of the metals and the other metal. When the degradable substance is a degradable metal material, the degradable metal material degrades by galvanic corrosion.

Degradation by swell involves the absorption by the degradable substance of a fluid in the wellbore environment such that the mechanical properties of the degradable substance degrade. That is, the degradable substance continues to absorb the fluid until its mechanical properties are no longer capable of maintaining the integrity of the degradable substance and it at least partially falls apart. In some embodiments, a degradable substance may be designed to only partially degrade by swelling in order to ensure that the mechanical properties of the component of the wellbore tool 316 formed from the degradable substance is sufficiently capable of lasting for the duration of the specific operation in which it is utilized. Degradation by dissolving involves use of a degradable substance that is soluble or otherwise susceptible to a fluid in the wellbore environment (e.g., an aqueous fluid or a hydrocarbon fluid), such that the fluid is not necessarily incorporated into the degradable substance (as is the case with degradation by swelling), but becomes soluble upon contact with the fluid. Degradation by undergoing a chemical change may involve breaking the bonds of the backbone of the degradable substance (e.g., polymer backbone) or causing the bonds of the degradable substance to crosslink, such that the degradable substance becomes brittle and breaks into smaller pieces upon contact with even small forces expected in the wellbore environment. Thermal degradation involves a chemical decomposition due to heat, such as the heat present in a wellbore environment. Thermal degradation of some degradable substances described herein may occur at wellbore environment temperatures of greater than about 93° C. (or about 200° F.), or greater than about 50° C. (or about 122° F.). Each degradation method may work in concert with one or more of the other degradation methods, without departing from the scope of the present disclosure.

Referring now to the degradable metal materials of the present disclosure, the term "degradable metal material" (also referred to simply as "degradable metal" herein) may refer to the rate of dissolution of the degradable metal material, and the rate of dissolution may correspond to a rate of material loss at a particular temperature and within a particular wellbore environment, such as in the presence of an electrolyte. In at least one embodiment, the degradable metal materials described herein exhibit an average degradation rate in an amount of greater than about 0.01 milligrams per square centimeters ($mg/cm^2$) per hour at 93° C. (equivalent to about 200° F.) while exposed to a 15% potassium chloride (KCl) solution. For example, in some embodiments, the degradable metal materials may have an average degradation rate of greater than in the range of from about 0.01 $mg/cm^2$ to about 10 $mg/cm^2$ per hour at a temperature of about 93° C. while exposed to a 15% KCl solution, encompassing any value and subset therebetween. For example, the degradation rate may be about 0.01

$mg/cm^2$ to about 2.5 $mg/cm^2$, or about 2.5 $mg/cm^2$ to about 5 $mg/cm^2$, or about 5 $mg/cm^2$ to about 7.5 $mg/cm^2$, or about 7.5 $mg/cm^2$ to about 10 $mg/cm^2$ per hour at a temperature of 93° C. while exposed to a 15% KCl solution, encompassing any value and subset therebetween.

In other instances, the degradable metal material may exhibit a degradation rate such that it loses greater than about 0.1% of its total mass per day at 93° C. In a 15% KCl solution. For example, in some embodiments, the degradable metal materials described herein may have a degradation rate such that it loses about 0.1% to about 10% of its total mass per day at 93° C. in a 15% KCl solution, encompassing any value and subset therebetween. For example, in some embodiments the degradable metal material may lose about 0.1% to about 2.5%, or about 2.5% to about 5%, or about 5% to about 7.5%, or about 7.5% to about 10% of its total mass per day at 93° C. in a 15% KCl solution, encompassing any value and subset therebetween. Each of these values representing the degradable metal material is critical to the embodiments of the present disclosure and may depend on a number of factors including, but not limited to, the type of degradable metal material, the wellbore environment, and the like.

It should be noted that the various degradation rates noted in a 15% KCl solution are merely a means of defining the degradation rate of the degradable metal materials described herein by reference to contact with a specific electrolyte at a specific temperature. The wellbore tool 316 and the degradable, frangible components described herein having a degradable metal material may be exposed to other wellbore environments to initiate degradation, without departing from the scope of the present disclosure.

It should be further noted, that the non-metal degradable materials also discussed herein, which may be used for forming the degradable, frangible components described herein may additionally have a degradation rate in the same amount or range as that of the degradable metal material, which may allow use of certain degradable materials that degrade at a rate faster or slower than other degradable materials (including the degradable metal materials) for forming the degradable, frangible components described herein.

The degradation of the degradable metal material may be in the range of from about 5 days to about 40 days, encompassing any value or subset therebetween. For example, the degradation may be about 5 days to about 10 days, or about 10 days to about 20 days, or about 20 days to about 30 days, or about 30 days to about 40 days, encompassing any value and subset therebetween. Each of these values representing the degradable metal material is critical to the embodiments of the present disclosure and may depend on a number of factors including, but not limited to, the type of degradable metal material, the wellbore environment, and the like.

Suitable degradable metal materials that may be used in accordance with the embodiments of the present disclosure include galvanically-corrodible or degradable metals and metal alloys. Such metals and metal alloys may be configured to degrade via galvanic corrosion in the presence of an electrolyte (e.g., brine or other salt-containing fluids present within the wellbore 106). As used herein, an "electrolyte" is any substance containing free ions (i.e., a positively or negatively charged atom or group of atoms) that make the substance electrically conductive. The electrolyte can be selected from the group consisting of, solutions of an acid, a base, a salt, and combinations thereof.

Electrolytes may include, but are not limited to, a halide anion (i.e., fluoride, chloride, bromide, iodide, and astatide), a halide salt, an oxoanion (including monomeric oxoanions and polyoxoanions), and any combination thereof. Suitable examples of halide salts for use as the electrolytes of the present disclosure may include, but are not limited to, a potassium fluoride, a potassium chloride, a potassium bromide, a potassium iodide, a sodium chloride, a sodium bromide, a sodium iodide, a sodium fluoride, a calcium fluoride, a calcium chloride, a calcium bromide, a calcium iodide, a zinc fluoride, a zinc chloride, a zinc bromide, a zinc iodide, an ammonium fluoride, an ammonium chloride, an ammonium bromide, an ammonium iodide, a magnesium chloride, potassium carbonate, potassium nitrate, sodium nitrate, and any combination thereof. The oxyanions for use as the electrolyte of the present disclosure may be generally represented by the formula $A_xO_y^{z-}$, where A represents a chemical element and O is an oxygen atom; x, y, and z are integers between the range of about 1 to about 30, and may be or may not be the same integer. Examples of suitable oxoanions may include, but are not limited to, carbonate (e.g., hydrogen carbonate ($HCO_3^-$)), borate, nitrate, phosphate (e.g., hydrogen phosphate ($HPO_4^{2-}$)), sulfate, nitrite, chlorite, hypochlorite, phosphite, sulfite, hypophosphite, hyposulfite, triphosphate, and any combination thereof. Other common free ions that may be present in an electrolyte may include, but are not limited to, sodium ($Na^+$), potassium ($K^+$), calcium ($Ca^{2+}$), magnesium ($Mg^{2+}$), and any combination thereof. Preferably, the electrolyte contains chloride ions. The electrolyte can be a fluid that is introduced into the wellbore 106 or a fluid emanating from the wellbore 306, such as from a surrounding subterranean formation (e.g., the formation 308 of FIG. 3).

In some embodiments, the electrolyte may be present in an aqueous base fluid up to saturation for contacting the degradable metal material, which may vary depending on the type of degradable metal material, the aqueous base fluid selected, and the like, and any combination thereof. In other embodiments, the electrolyte may be present in the aqueous base fluid in the range of from about 0.001% to about 30% by weight of the aqueous base fluid, encompassing any value and subset therebetween. For example, the electrolyte may be present from about 0.001% to about 0.01%, or about 0.01% to about 1%, or about 1% to about 6%, or about 6% to about 12%, or about 12% to about 18%, or about 18% to about 24%, or about 24% to about 30% by weight of the aqueous base fluid. Each of these values is critical to the embodiments of the present disclosure and may depend on a number of factors including, but not limited to, the composition of the degradable metal material, the components of the wellbore tool composed of the degradable metal material, the type of electrolyte selected, other conditions of the wellbore environment, and the like.

The degradable metal materials for use in forming at least the degradable, frangible components described herein may include a metal material that is galvanically corrodible in a wellbore environment, such as in the presence of an electrolyte, as previously discussed. Suitable such degradable metal materials may include, but are not limited to, gold, gold-platinum alloys, silver, nickel, nickel-copper alloys, nickel-chromium alloys, copper, copper alloys (e.g., brass, bronze, etc.), chromium, tin, tin alloys (e.g., pewter, solder, etc.), aluminum, aluminum alloys (e.g., silumin alloy, a magnalium alloy, etc.), iron, iron alloys (e.g., cast iron, pig iron, etc.), zinc, zinc alloys (e.g., zamak, etc.), magnesium, magnesium alloys (e.g., elektron, magnox, etc.), beryllium, beryllium alloys (e.g., beryllium-copper alloys, beryllium-nickel alloys), and any combination thereof.

Suitable magnesium alloys include alloys having magnesium at a concentration in the range of from about 60% to about 99.95% by weight of the magnesium alloy, encompassing any value and subset therebetween. In some embodiments, the magnesium concentration may be in the range of about 60% to about 99.95%, 70% to about 98%, and preferably about 80% to about 95% by weight of the magnesium alloy, encompassing any value and subset therebetween. Each of these values is critical to the embodiments of the present disclosure and may depend on a number of factors including, but not limited to, the type of magnesium alloy, the desired degradability of the magnesium alloy, and the like.

Magnesium alloys comprise at least one other ingredient besides the magnesium. The other ingredients can be selected from one or more metals, one or more non-metals, or a combination thereof. Suitable metals that may be alloyed with magnesium include, but are not limited to, lithium, sodium, potassium, rubidium, cesium, beryllium, calcium, strontium, barium, aluminum, gallium, indium, tin, thallium, lead, bismuth, scandium, titanium, vanadium, chromium, manganese, iron, cobalt, nickel, copper, zinc, yttrium, zirconium, niobium, molybdenum, ruthenium, rhodium, palladium, praseodymium, silver, lanthanum, hafnium, tantalum, tungsten, terbium, rhenium, osmium, iridium, platinum, gold, neodymium, gadolinium, erbium, oxides of any of the foregoing, and any combinations thereof.

Suitable non-metals that may be alloyed with magnesium include, but are not limited to, graphite, carbon, silicon, boron nitride, and combinations thereof. The carbon can be in the form of carbon particles, fibers, nanotubes, fullerenes, and any combination thereof. The graphite can be in the form of particles, fibers, graphene, and any combination thereof. The magnesium and its alloyed ingredient(s) may be in a solid solution and not in a partial solution or a compound where inter-granular inclusions may be present. In some embodiments, the magnesium and its alloyed ingredient(s) may be uniformly distributed throughout the magnesium alloy but, as will be appreciated, some minor variations in the distribution of particles of the magnesium and its alloyed ingredient(s) can occur. In other embodiments, the magnesium alloy is a sintered construction.

In some embodiments, the magnesium alloy may have a yield stress in the range of from about 20000 pounds per square inch (psi) to about 50000 psi, encompassing any value and subset therebetween. For example, in some embodiments, the magnesium alloy may have a yield stress of about 20000 psi to about 30000 psi, or about 30000 psi to about 40000 psi, or about 40000 psi to about 50000 psi, encompassing any value and subset therebetween. Each of these values is critical to the embodiments of the present disclosure and may depend on a number of factors including, but not limited to, the dimensions and minimum shear stress requirements of the degradable, frangible components described herein formed from the degradable magnesium alloy, the composition of the degradable magnesium alloy selected, and the like, and any combination thereof.

Suitable aluminum alloys include alloys having aluminum at a concentration in the range of from about 40% to about 99% by weight of the aluminum alloy, encompassing any value and subset therebetween. For example, suitable magnesium alloys may have aluminum concentrations of about 40% to about 50%, or about 50% to about 60%, about 60% to about 70%, or about 70% to about 80%, or about 80% to about 90%, or about 90% to about 99% by weight of the aluminum alloy, encompassing any value and subset therebetween. Each of these values is critical to the embodiments of the present disclosure and may depend on a number of factors including, but not limited to, the type of aluminum alloy, the desired degradability of the aluminum alloy, and the like.

The aluminum alloys may be wrought or cast aluminum alloys and comprise at least one other ingredient besides the aluminum. The other ingredients can be selected from one or more of any of the metals, non-metals, and combinations thereof described above with reference to magnesium alloys, with the addition of the aluminum alloys additionally being able to comprise magnesium.

In some embodiments, the degradable metal materials may be a degradable metal alloy, which may exhibit a nano-structured matrix form and/or inter-granular inclusions (e.g., a magnesium alloy with iron-coated inclusions). Such degradable metal alloys may further include a dopant, where the presence of the dopant and/or the inter-granular inclusions increases the degradation rate of the degradable metal alloy. Other degradable metal materials include solution-structured galvanic material. An example of a solution-structured galvanic material is zirconium (Zr) containing a magnesium (Mg) alloy, where different domains within the alloy contain different percentages of Zr. This leads to a galvanic coupling between these different domains, which cause micro-galvanic corrosion and degradation. Another example of a solution-structured galvanically-corrodible material is a ZK60 magnesium alloy, which includes 4.5% to 6.5% zinc, minimum 0.25% zirconium, 0% to 1% other, and balance magnesium; AZ80, which includes 7.5% to 9.5% aluminum, 0.2% to 0.8% zinc, 0.12% manganese, 0.015% other, and balance magnesium; and AZ31, which includes 2.5% to 3.5% aluminum, 0.5% to 1.5% zinc, 0.2% manganese, 0.15% other, and the balance magnesium. Each of these examples is % by weight of the metal alloy. In some embodiments, "other" may include unknown materials, impurities, additives, and any combination thereof.

The degradable metal magnesium alloys may be solution structured with other elements such as zinc, aluminum, nickel, iron, carbon, tin, silver, copper, titanium, rare earth elements, and the like, and any combination thereof. Degradable metal aluminum alloys may be solution structured with elements such as nickel, iron, carbon, tin, silver, copper, titanium, gallium, and the like, and any combination thereof.

In some embodiments, an alloy, such as a magnesium alloy or an aluminum alloy described herein has a dopant included therewith, such as during fabrication. For example, the dopant may be added to one of the alloying elements prior to mixing all of the other elements in the alloy. For example, during the fabrication of an AZ aluminum alloy, the dopant (e.g., zinc) may be dissolved in aluminum, followed by mixing with the remaining alloy, magnesium, and other components if present. Additional amounts of the aluminum may be added after dissolving the dopant, as well, without departing from the scope of the present disclosure, in order to achieve the desired composition. Suitable dopants for inclusion in the degradable metal alloy materials described herein may include, but are not limited to, iron, copper, nickel, gallium, carbon, tungsten, silver, mercury, indium, and any combination thereof.

The dopant may be included with the magnesium and/or aluminum alloy degradable metal materials described herein in an amount of from about 0.05% to about 15% by weight of the degradable metal material, encompassing every value and subset therebetween. For example, the dopant may be present in an amount of from about 0.05% to about 3%, or about 3% to about 6%, or about 6% to about 9%, or about 9% to about 12%, or about 12% to about 15% by weight of the degradable metal material, encompassing every value and subset therebetween. Other examples include a dopant in an amount of from about 1% to about 10% by weight of the degradable metal material, encompassing every value and subset therebetween. Each of these values is critical to the embodiments of the present disclosure and may depend on a number of factors including, but not limited to, the type of magnesium and/or aluminum alloy selected, the desired rate of degradation, the wellbore environment, and the like, and any combination thereof.

As specific examples, the magnesium alloy degradable metal material may comprise a nickel dopant in the range of about 0.1% to about 6% (e.g., about 0.1%, about 0.5%, about 1%, about 2%, about 3%, about 4%, about 5%, about 6%) by weight of the alloy, encompassing any value and subset therebetween; a copper dopant in the range of about 6% to about 12% (e.g., about 6%, about 7%, about 8%, about 9%, about 10%, about 11%, about 12%) by weight of the alloy, encompassing any value and subset therebetween; and/or an iron dopant in the range of about 2% to about 6% (e.g., about 2%, about 3%, about 4%, about 5%, about 6%) by weight of the alloy, encompassing any value and subset therebetween. As described above, each of these values is critical to the embodiments of the present disclosure to at least affect the degradation rate of the magnesium alloy.

As specific examples, the aluminum alloy degradable metal material may comprise a copper dopant in the range of about 8% to about 15% (e.g., about 8%, about 9%, about 10%, about 11%, about 12%, about 13%, about 14%, about 15%) by weight of the alloy, encompassing any value and subset therebetween; a mercury dopant in the range of about 0.2% to about 4% (e.g., about 0.2%, about 0.5%, about 1%, about 2%, about 3%, about 4%) by weight of the alloy, encompassing any value and subset therebetween; a nickel dopant in the range of about 1% to about % (e.g., about 1%, about 2%, about 3%, about 4%, about 5%, about 6%, about 7%) by weight of the alloy, encompassing any value and subset therebetween; a gallium dopant in the range of about 0.2% to about 4% (e.g., about 0.2%, about 0.5%, about 1%, about 2%, about 3%, about 4%) by weight of the alloy, encompassing any value and subset therebetween; and/or an iron dopant in the range of about 2% to about 7% (e.g., about 2%, about 3%, about 4%, about 5%, about 6%, about 7%) by weight of the alloy, encompassing any value and subset therebetween. As described above, each of these values is critical to the embodiments of the present disclosure to at least affect the degradation rate of the aluminum alloy.

The degradable metal materials (e.g., magnesium and/or aluminum alloys) described herein may further comprise an amount of material, termed "supplementary material," that is defined as neither the primary alloy, other specific alloying materials forming the doped alloy, or the dopant. This supplementary material may include, but is not limited to, unknown materials, impurities, additives (e.g., those purposefully included to aid in mechanical properties), and any combination thereof. The supplementary material minimally, if at all, effects the acceleration of the corrosion rate of the doped alloy. Accordingly, the supplementary material may, for example, inhibit the corrosion rate or have no affect thereon. As defined herein, the term "minimally" with reference to the effect of the acceleration rate refers to an effect of no more than about 5% as compared to no supplementary material being present. This supplementary material may enter the degradable metal materials of the present disclosure due to natural carry-over from raw materials, oxidation of the degradable metal material or other elements, manufacturing processes (e.g., smelting processes, casting processes, alloying processes, and the like), or the like, and any combination thereof. Alternatively, the supplementary material may be intentionally included additives placed in the degradable metal material to impart a beneficial quality thereto, such as a reinforcing agent, a corrosion retarder, a corrosion accelerant, a reinforcing agent (i.e., to increase strength or stiffness, including, but not limited to, a fiber, a particulate, a fiber weave, and the like, and combinations thereof), silicon, calcium, lithium, manganese, tin, lead, thorium, zirconium, beryllium, cerium, praseodymium, yttrium, and the like, and any combination thereof. Generally, the supplemental material is present in the degradable metal material described herein in an amount of less than about 10% by weight of the degradable metal material, including no supplemental material at all (i.e., 0%).

Examples of specific magnesium alloy degradable metal materials for use in the embodiments of the present disclosure may include, but are not limited to, a doped MG magnesium alloy, a doped WE magnesium alloy, a doped AZ magnesium alloy, a doped AM magnesium alloy, or a doped ZK magnesium alloy. As defined herein, a "doped MG magnesium alloy" is an alloy comprising at least magnesium, dopant, and optional supplemental material, as defined herein; a "doped WE magnesium alloy" is an alloy comprising at least a rare earth metal, magnesium, dopant, and optional supplemental material, as defined herein; a "doped AZ magnesium alloy" is an alloy comprising at least aluminum, zinc, magnesium, dopant, and optional supplemental material, as defined herein; a "doped AM magnesium" is an alloy comprising at least aluminum, manganese, magnesium, dopant, and optional supplemental material, as defined herein; and a "ZK magnesium alloy" is an alloy comprising at least zinc, zirconium, magnesium, dopant, and optional supplemental material, as defined herein.

The doped MG magnesium alloy comprises about 75% to about 99.95% of magnesium, about 0.05% to about 15% of dopant, and about 0% to about 10% of supplemental material, each by weight of the doped MG magnesium alloy. The doped WE magnesium alloy comprises about 60% to about 98.95% of magnesium, about 1% to about 15% of a rare earth metal or combination of rare earth metals, about 0.05% to about 15% of dopant, and about 0% to about 10% of supplemental material, each by weight of the doped WE magnesium alloy. The rare earth metal may be selected from the group consisting of scandium, lanthanum, cerium, praseodymium, neodymium, promethium, samarium, europium, gadolinium, dysprosium, holmium, erbium, thulium, ytterbium, lutetium, yttrium, and any combination thereof. The doped AZ magnesium alloy comprises about 57.3% to about 98.85% of magnesium, about 1% to about 12.7% of aluminum, about 0.05% to about 15% of dopant, and about 0% to about 10% of supplemental material, each by weight of the doped AZ magnesium alloy. The doped ZK magnesium alloy comprises about 58% to about 98.94% of magnesium, about 1% to about 12% of zinc, about 0.01% to about 5% of zirconium, about 0.05% to about 15% of dopant, and about 0% to about 10% of supplemental material, each by weight of the doped ZK magnesium alloy. The doped AM magnesium alloy comprises about 61% to about 97.85% of magnesium, about 2% to about 10% of aluminum, about 0.1% to about 4% of manganese, about 0.05% to about 15% of dopant, and about 0% to about 10% of supplemental material, each by weight of the doped AM magnesium alloy. Each of these values is critical to the embodiments of the present disclosure and may depend on a number of factors including, but not limited to, the desired degradation rate, the type of dopant(s) selected, the presence and type of supplemental material, and the like, and combinations thereof.

Examples of specific aluminum alloy degradable metal materials for use in the embodiments of the present disclosure may include, but are not limited to, a doped silumin aluminum alloy (also referred to simply as "a doped silumin alloy"), a doped Al—Mg aluminum alloy, a doped Al—Mg—Mn aluminum alloy, a doped Al—Cu aluminum alloy, a doped Al—Cu—Mg aluminum alloy, a doped Al—Cu—Mn—Si aluminum alloy, a doped Al—Cu—Mn—Mg aluminum alloy, a doped Al—Cu—Mg—Si—Mn aluminum alloy, a doped Al—Zn aluminum alloy, a doped Al—Cu—Zn aluminum alloy, and any combination thereof. As defined herein, a "doped silumin aluminum alloy" is an alloy comprising at least silicon, aluminum, dopant, and optional supplemental material, as defined herein; a "doped Al—Mg aluminum alloy" is an alloy comprising at least magnesium, aluminum, dopant, and optional supplemental material, as defined herein; a "doped Al—Mg—Mn aluminum alloy" is an alloy comprising at least magnesium, manganese, aluminum, dopant, and optional supplemental material, as defined herein; a "doped Al—Cu aluminum alloy" is an alloy comprising at least copper, aluminum, dopant, and optional supplemental material, as defined herein; a "doped Al—Cu—Mg aluminum alloy" is an alloy comprising at least copper, magnesium, aluminum, dopant, and optional supplemental material, as defined herein; a "doped Al—Cu—Mn—Si aluminum alloy" is an alloy comprising at least copper, manganese, silicon, aluminum, dopant, and optional supplemental material, as defined herein; a "doped Al—Cu—Mn—Mg aluminum alloy" is an alloy comprising at least copper, manganese, magnesium, aluminum, dopant, and optional supplemental material, as defined herein; a "doped Al—Cu—Mg—Si—Mn aluminum alloy" is an alloy comprising at least copper, magnesium, silicon, manganese, aluminum, dopant, and optional supplemental material, as defined herein; a "doped Al—Zn aluminum alloy" is an alloy comprising at least zinc, aluminum, dopant, and optional supplemental material, as defined herein; and a "doped Al—Cu—Zn aluminum alloy" is an alloy comprising at least copper, zinc, aluminum, dopant, and optional supplemental material, as defined herein.

The doped silumin aluminum alloy comprises about 62% to about 96.95% of aluminum, about 3% to about 13% silicon, about 0.05% to about 15% of dopant, and about 0% to about 10% of supplemental material, each by weight of the doped silumin aluminum alloy. The doped Al—Mg aluminum alloy comprises about 62% to about 99.45% of aluminum, about 0.5% to about 13% of magnesium, about 0.05% to about 15% of dopant, and about 0% to about 10% of supplemental material, each by weight of the doped Al—Mg aluminum alloy. The doped Al—Mg—Mn aluminum alloy comprises about 67 to about 99.2% of aluminum, about 0.5% to about 7% of magnesium, about 0.25% to about 1% of manganese, about 0.05% to about 15% of dopant, and about 0% to about 10% of supplemental material, each by weight of the doped Al—Mg—Mn aluminum alloy. The doped Al—Cu aluminum alloy comprises about 64% to about 99.85% of aluminum, about 0.1% to about 11% of copper, about 0.05% to about 15% of dopant, and about 0% to about 10% of supplemental material, each by weight of the doped Al—Cu aluminum alloy.

The doped Al—Cu—Mg aluminum alloy comprises about 61% to about 99.6% of aluminum, about 0.1% to about 13% of copper, about 0.25% to about 1% of magnesium, about 0.05% to about 15% of dopant, and about 0% to about 10% of supplemental material, each by weight of the doped Al—Cu—Mg aluminum alloy. The doped Al—Cu—Mn—Si aluminum alloy comprises about 68.25% to about 99.35% of aluminum, about 0.1% to about 5% of copper, about 0.25% to about 1% of manganese, about 0.25% to about 0.75% of silicon, about 0.05% to about 15% of dopant, and about 0% to about 10% of supplemental material, each by weight of the doped Al—Cu—Mn—Si aluminum alloy. The doped Al—Cu—Mn—Mg aluminum alloy comprises about 70.5% to about 99.35% of aluminum, about 0.1% to about 3% of copper, about 0.25% to about 0.75% of manganese, about 0.25% to about 0.75% of magnesium, about 0.05% to about 15% of dopant, and about 0% to about 10% of supplemental material, each by weight of the doped Al—Cu—Mn—Mg aluminum alloy. The doped Al—Cu—Mg—Si—Mn aluminum alloy comprises about 67.5% to about 99.49% of aluminum, about 0.5% to about 5% of copper, about 0.25% to about 2% of magnesium, about 0.1% to about 0.4% of silicon, about 0.01% to about 0.1% of manganese, about 0.05% to about 15% of dopant, and about 0% to about 10% of supplemental material, each by weight of the doped Al—Cu—Mg—Si—Mn aluminum alloy. The doped Al—Zn aluminum alloy comprises about 45% to about 84.95% of aluminum, about 15% to about 30% of zinc, about 0.05% to about 15% of dopant, and about 0% to about 10% of supplemental material, each by weight of the doped Al—Zn aluminum alloy. The doped Al—Cu—Zn aluminum alloy comprises about 63% to about 99.75% of aluminum, about 0.1% to about 10% of copper, about 0.1% to about 2% of zinc, about 0.05% to about 15% of dopant, and about 0% to about 10% of supplemental material, each by weight of the doped Al—Cu—Zn aluminum alloy.

In some embodiments, where at least two components of the wellbore tool 316 are formed from a degradable metal material (e.g., a degradable magnesium and/or aluminum alloy), each component may comprise dissimilar metals that generate a galvanic coupling that either accelerates or decelerates the degradation rate of another component of the wellbore tool 316 that is at least partially composed of a degradable substance, whether a degradable metal material or a degradable non-metal material (e.g., a degradable elastomer). For example, a shear pin and a shear ring may be formed of dissimilar metals that generate a galvanic coupling.

As will be appreciated, such embodiments may depend on where the dissimilar metals lie on the galvanic series. In at least one embodiment, a galvanic coupling may be generated by embedding or attaching a cathodic substance or piece of material into an anodic component. For instance, the galvanic coupling may be generated by dissolving aluminum in gallium. A galvanic coupling may also be generated by using a sacrificial anode coupled to the degradable metal material. In such embodiments, the degradation rate of the degradable metal material may be decelerated until the sacrificial anode is dissolved or otherwise corroded away.

In other embodiments, the degradable, frangible components described herein may be composed of a degradable metal material with reinforcing agents dispersed therein, which may increase the strength and stiffness of the component of degradable, frangible components. Such reinforcing agents may be degradable or nondegradable and may be particulates, fibers, fiber weavers, and any combination thereof.

Degradable reinforcing agents may be formed of a degradable glass material, particulate solid anhydrous borate materials, and organic or inorganic salts. Exemplary degradable glass materials may include, but are not limited to, glass polyalkenoate, borate glass polyalkenoate, calcium phosphate glass, polylactic acid/calcium phosphate glass, phosphate glass, silica glass, and any combination thereof. A dehydrated salt is suitable for use in the embodiments of the present disclosure if it will degrade over time as it hydrates. For example, a particulate solid anhydrous borate material that degrades over time may be suitable. Specific examples of particulate solid anhydrous borate materials that may be used include, but are not limited to, anhydrous sodium tetraborate (also known as anhydrous borax), and anhydrous boric acid. These anhydrous borate materials are only slightly soluble in water. However, with time and heat in a subterranean environment, the anhydrous borate materials react with the surrounding aqueous fluid and are hydrated. The resulting hydrated borate materials are highly soluble in water as compared to anhydrous borate materials and as a result degrade in the aqueous fluid. In some instances, the total time required for the anhydrous borate materials to degrade in an aqueous fluid is in the range of from about 8 hours to about 72 hours depending upon the temperature of the subterranean zone in which they are placed. Other examples include organic or inorganic salts like acetate trihydrate.

The particulate reinforcing agents may be of any size suitable for embedding in the degradable metal material, such as in the range of from about 400 mesh to about 40 mesh, U.S. Sieve Series, and encompassing any value or subset therebetween. For example, the size of particulate for embedding in the degradable metal material may be in the range of about 400 mesh to about 300 mesh, or about 300 mesh to about 200 mesh, or about 200 mesh to about 100 mesh, or about 100 mesh to about 40 mesh, encompassing any value and subset therebetween. Moreover, there is no need for the particulates to be sieved or screened to a particular or specific particle mesh size or particular particle size distribution, but rather a wide or broad particle size distribution can be used, although a narrow particle size distribution is also suitable.

In some embodiments, the particulates may be substantially spherical or non-spherical. Substantially non-spherical proppant particulates may be cubic, polygonal, or any other non-spherical shape. Such substantially non-spherical particulates may be, for example, cubic-shaped, rectangular-shaped, rod-shaped, ellipse-shaped, cone-shaped, pyramid-shaped, planar-shaped, oblate-shaped, or cylinder-shaped. That is, in embodiments wherein the particulates are substantially non-spherical, the aspect ratio of the material may range such that the material is planar to such that it is cubic, octagonal, or any other configuration.

Particulates suitable for use as reinforcing agents in the embodiments described herein may comprise any material suitable for use in the degradable metals and metal alloys that provides one or more of stiffness, strength, or creep resistance, or any other added benefit. Suitable materials for these particulates may include, but are not limited to, boron carbide, tungsten carbide, silicon carbide, titanium carbide, boron nitride, osmium diboride, rhenium boride, tungsten boride, silica nitride, synthetic diamond, silida, zirconia, alumina, emery, organophilic clay, silica flour, metal oxide, sand, bauxite, ceramic materials, glass materials, polymer materials (e.g., ethylene vinyl acetate or composite materials), polytetrafluoroethylene materials, and combinations thereof. Suitable composite particulates may comprise a binder and a filler material wherein suitable filler materials include silica, alumina, fumed carbon, carbon black, graphite, mica, titanium dioxide, barite, meta-silicate, calcium silicate, kaolin, talc, zirconia, boron, fly ash, hollow glass microspheres, solid glass, and combinations thereof.

The fibers for use as reinforcing agents in the degradable metal material may be of any size and material capable of being included therein. In some embodiments, the fibers may have a length of less than about 1.25 inches and a width of less than about 0.01 inches. In some embodiments, a mixture of different sizes of fibers may be used. Suitable fibers may be formed from any material suitable for use as a particulate, as described previously, as well as materials including, but not limited to, carbon fibers, carbon nanotubes, graphene, fullerene, a ceramic fiber, a plastic fiber, a glass fiber, a metal fiber, and any combination thereof. In some embodiments, the fibers may be woven together to form a fiber weave for use in the degradable metal material.

In some embodiments, the reinforcing agent may be included in the degradable metal material in an amount in the range of from about 1% to about 91% by weight of the degradable metal material, encompassing any value or subset therebetween. For example, the reinforcing agent may be included in an amount of about 1% to about 25%, or about 25% to about 50%, or about 50% to about 75%, or about 75% to about 91% by weight of the degradable metal material encompassing any value or subset therebetween. Each of these values is critical to the embodiments of the present disclosure and may depend on a number of factors including, but not limited to, the desired stiffness of the degradable metal material, the desired strength of the degradable metal material, the type of degradable metal material selected, and the like, and any combination thereof.

According to an embodiment, each of the degradable substance(s) may include one or more tracers present therein. The tracer(s) can be, without limitation, radioactive, chemical, electronic, or acoustic. A tracer can be useful in determining real-time information on the rate of dissolution of the degradable substance. By being able to monitor the presence of the tracer, workers at the surface can make on-the-fly decisions that can affect the rate of dissolution of the remaining portions of the frangible, degradable component described herein.

In some embodiments, the degradable metal material may be at least partially encapsulated in a second material or "sheath" disposed on all or a portion of the frangible, degradable component described herein. The sheath may be configured to help prolong degradation of the frangible, degradable component described herein. The sheath may also serve to protect the component from abrasion within the wellbore. The sheath may be permeable, frangible (e.g., as discussed previously with regard to compressing the packer element against the casing or wall of the wellbore), or comprise a material that is at least partially removable at a desired rate within the wellbore environment. In either scenario, the sheath may be designed such that it does not interfere with the ability of the frangible, degradable component described herein to maintain its integrity until a desired shear stress is applied.

The sheath may comprise any material capable of use in a downhole environment and, depending on the component that the sheath encapsulates, the sheath may or may not be elastic such that it is able to expand with corresponding expansion of the component. For instance, a frangible sheath may break as the packer elements expand to form a fluid seal by compressing against a casing or wall of a wellbore, whereas a permeable sheath may remain in place on the packer elements as they form the fluid seal. As used herein, the term "permeable" refers to a structure that permits fluids (including liquids and gases) therethrough and is not limited to any particular configuration.

The sheath may comprise any of the afore-mentioned degradable substances. In some embodiments, the sheath may be made of a degradable substance that degrades at a rate that is faster than that of the underlying degradable substance that forms the component. Other suitable materials for the sheath include, but are not limited to, a TEFLON® coating, a wax, a drying oil, a polyurethane, an epoxy, a cross-linked partially hydrolyzed polyacrylic, a silicate material, a glass, an inorganic durable material, a polymer, polylactic acid, polyvinyl alcohol, polyvinylidene chloride, a hydrophobic coating, paint, and any combination thereof.

In some embodiments, all or a portion of the outer surface of the frangible, degradable component described herein may be treated to impede degradation. For example, the outer surface of a given component may undergo a treatment that aids in preventing the degradable substance from degrading, or that aids in reducing the degradation rate. Suitable treatments may include, but are not limited to, an anodizing treatment, an oxidation treatment, a chromate conversion treatment, a dichromate treatment, a fluoride anodizing treatment, a hard anodizing treatment, and any combination thereof. As an example, an anodizing treatment may result in an anodized layer of material being deposited on the outer surface of a given component. The anodized layer may comprise materials such as, but not limited to, ceramics, metals, polymers, epoxies, elastomers, plastics, or any combination thereof and may be applied using any suitable processes known to those of skill in the art. Examples of suitable processes that result in an anodized layer include, but are not limited to, soft anodized coating, anodized coating, electroless nickel plating, hard anodized coating, ceramic coatings, carbide beads coating, plastic coating, thermal spray coating, high velocity oxygen fuel (HVOF) coating, a nano HVOF coating, a metallic coating.

In some embodiments, all or a portion of the outer surface of the frangible, degradable component described herein may be treated or coated with a substance configured to enhance degradation of the degradable material. For example, such a treatment or coating may be configured to remove a protective coating or treatment or otherwise accelerate the degradation of the degradable substance of the given component. An example is a degradable metal material coated with a layer of polyglycolic acid (PGA). In this example, the PGA would undergo hydrolysis and cause the surrounding fluid to become more acidic, which would accelerate the degradation of the underlying degradable metal material.

Embodiments described herein may include, but are not limited to, Embodiments A-C.

Embodiment A is a method comprising: introducing a wellbore tool into a wellbore penetrating a subterranean formation, the wellbore tool comprising a frangible, degradable component, wherein the frangible, degradable component comprise a degradable metal alloy selected from the group consisting of a magnesium alloy, an aluminum alloy, and any combination thereof; applying a shear stress to the frangible, degradable component sufficient to break the frangible, degradable component, thereby producing pieces of the frangible, degradable component; contacting the degradable metal alloy with an electrolyte; and at least partially degrading the degradable metal alloy. Embodiment A may optionally include at least one of the following: Element 1: wherein the frangible, degradable component is a first frangible, degradable component that is a shear pin and the wellbore tool further comprises a second frangible, degradable component that is a shear ring; Element 2: Element 1 and wherein the shear pin and the shear ring each comprise dissimilar metals that generate a galvanic coupling; Element 3: wherein the degradable metal alloy further comprises a reinforcing agent; Element 4: Element 3 and wherein the reinforcing agent comprises fibers; Element 5: wherein the wellbore tool is a sliding sleeve and the method further comprises: actuating the sliding sleeve after applying the shear stress to the frangible, degradable component sufficient to break the frangible, degradable component; Element 6: wherein the wellbore tool is a stinger coupling a conveyance to a second wellbore tool and the method further comprises: separating the stinger and the conveyance from the second wellbore tool after applying the shear stress to the frangible, degradable component sufficient to break the frangible, degradable component; Element 7: wherein the frangible, degradable component is a rupture disk; and Element 8: wherein the frangible, degradable component is a shear thread. Exemplary combinations may include, but are not limited to, Element 1 and optionally Element 2 in combination with Element 3; Element 3 and optionally Element 4 in combination with Element 5; Element 3 and optionally Element 4 in combination with Element 6; Element 3 and optionally Element 4 in combination with Element 7; and Element 3 and optionally Element 4 in combination with Element 8.

Embodiment B is a wellbore tool comprising: a housing; a port formed through a wall of the housing; a sliding sleeve disposed within the housing, the sliding sleeve having (1) a shut position in which an interior portion of the housing is fluidly isolated from the port and (2) an open position in which the interior portion of the housing is in fluid communication with the port; a frangible, degradable shear pin and a frangible, degradable shear ring operatively coupled between the sliding sleeve and the housing so as to fix the sliding sleeve in the shut position, wherein the frangible, degradable shear pin and the frangible, degradable shear ring independently comprise a degradable metal alloy selected from the group consisting of a magnesium alloy, an aluminum alloy, and any combination thereof.

Embodiment C is a tool string comprising: a conveyance or top adapter sub threadably coupled to a first end of a stinger; a wellbore tool coupled to the stinger via a coupling at a second end opposing the first end of the stinger, wherein the coupling comprises a frangible, degradable shear pin and a frangible, degradable shear ring, wherein the frangible, degradable shear pin and the frangible, degradable shear ring independently comprise a degradable metal alloy selected from the group consisting of a magnesium alloy, an aluminum alloy, and any combination thereof.

Embodiments B and C may optionally include at least one of the following: Element 9: wherein degradable metal alloy of the shear pin is dissimilar from and generates a galvanic coupling with the degradable metal alloy of the shear ring; Element 10: wherein the degradable metal alloy of the frangible, degradable shear pin further comprises a reinforcing agent; and Element 11: Element 10 and wherein the reinforcing agent comprises fibers.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the present invention. The invention illustratively disclosed herein suitably may be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces.

The invention claimed is:

1. A method comprising:

introducing a wellbore tool into a wellbore penetrating a subterranean formation, the wellbore tool comprising a frangible, degradable component, wherein the frangible, degradable component comprises, a degradable metal alloy selected from the group consisting of a magnesium alloy, an aluminum alloy, and any combination thereof; wherein the frangible, degradable component is a first frangible, degradable component and the wellbore tool further comprises a second frangible, degradable component, wherein the first frangible, degradable component and the second frangible, degradable component each compromise dissimilar metals that generate a galvanic coupling, wherein the first frangible, degradable component and the second frangible, degradable component are mechanically coupled with one another;

applying a shear stress to at least one of the first or second frangible, degradable component sufficient to break the frangible, degradable component, thereby producing pieces of the frangible, degradable component;

contacting the degradable metal alloy with an electrolyte; and at least partially degrading the degradable metal alloy.

2. The method of claim 1, wherein the first frangible, degradable component is a shear pin and the second frangible, degradable component is a shear ring.

3. The method of claim 1, wherein the degradable metal alloy further comprises a reinforcing agent.

4. The method of claim 3, wherein the reinforcing agent comprises fibers.

5. The method of claim 1, wherein the wellbore tool is a sliding sleeve and the method further comprises: actuating the sliding sleeve after applying the shear stress to the frangible, degradable component sufficient to break the frangible, degradable component.

6. The method of claim 1, wherein the wellbore tool is a stinger coupling a conveyance to a second wellbore tool and the method further comprises: separating the stinger and the conveyance from the second wellbore tool after applying the shear stress to the frangible, degradable component sufficient to break the frangible, degradable component.

7. The method of claim 1, wherein the wellbore tool further comprises a third frangible, degradable component that is a rupture disk.

8. The method of claim 1, wherein the wellbore tool further comprises a third frangible, degradable component that is a shear thread.

9. A wellbore tool comprising:

a housing;

a port formed through a wall of the housing;

a sliding sleeve disposed within the housing, the sliding sleeve having (1) a shut position in which an interior portion of the housing is fluidly isolated from the port, and (2) an open position in which the interior portion of the housing is in fluid communication with the port;

a frangible, degradable shear pin and a frangible, degradable shear ring operatively coupled between the sliding sleeve and the housing so as to fix the sliding sleeve in the shut position, wherein the frangible, degradable shear pin and the frangible, degradable shear ring independently comprise a degradable metal alloy selected from the group consisting of a magnesium alloy, an aluminum alloy, and any combination thereof; wherein the degradable metal alloy of the shear pin is dissimilar from and generates a galvanic coupling with the degradable metal alloy of the shear ring; wherein the shear ring and shear pin are mechanically coupled with one another.

10. The wellbore tool of claim 9, wherein the degradable metal alloy of the frangible, degradable shear pin further comprises a reinforcing agent.

11. The wellbore tool of claim 10, wherein the reinforcing agent comprises fibers.

12. A tool string comprising:

a conveyance or top adapter sub threadably coupled to a first end of a stinger;

a wellbore tool coupled to the stinger via a coupling at a second end opposing the first end of the stinger, wherein the coupling comprises a frangible, degradable shear pin and a frangible, degradable shear ring, wherein the frangible, degradable shear pin and the frangible, degradable shear ring independently comprise a degradable metal alloy selected from the group consisting of a magnesium alloy, an aluminum alloy, and any combination thereof; wherein the degradable metal alloy of the shear pin is dissimilar from and generates a galvanic coupling with the degradable metal alloy of the shear ring; wherein the shear ring and shear pin are mechanically coupled with one another.

13. The tool string of claim 12, wherein the degradable metal alloy of the frangible, degradable shear pin further comprises a reinforcing agent.

14. The tool string of claim 13, wherein the reinforcing agent comprises fibers.

* * * * *